United States Patent [19]

Colliver

[11] Patent Number: 4,562,016

[45] Date of Patent: Dec. 31, 1985

[54] EVAPORATIVE AIR-CONDITIONER WATER BLEED-OFF SYSTEM

[75] Inventor: Anthony D. Colliver, St. Marys, Australia

[73] Assignee: F.F. Seeley Nominees Pty. Ltd., St. Marys, Australia

[21] Appl. No.: 663,892

[22] Filed: Oct. 23, 1984

[30] Foreign Application Priority Data

Oct. 24, 1983 [AU] Australia ..... PG2019

[51] Int. Cl.[4] ..... B01F 3/04

[52] U.S. Cl. ..... 261/106; 62/304; 134/186; 261/29; 261/36 R; 261/DIG. 3; 261/DIG. 46

[58] Field of Search ..... 261/29, 36 R, 106, DIG. 3, 261/DIG. 41, DIG. 46; 137/577, 577.5, 578; 210/97, 99; 134/184, 186, 201; 62/304

[56] References Cited

U.S. PATENT DOCUMENTS

| | | | |
|---|---|---|---|
| 614,059 | 11/1898 | Noble | 137/578 |
| 1,300,383 | 4/1919 | Hall | 137/577 |
| 3,314,080 | 4/1967 | Shilling, Jr. | 261/DIG. 46 |
| 3,332,672 | 7/1967 | Schipper | 261/DIG. 46 |
| 3,481,588 | 12/1969 | Lobb | 261/DIG. 46 |
| 3,646,961 | 3/1972 | Marquardson | 137/577 |
| 3,773,307 | 11/1973 | Karlsson | 261/DIG. 46 |
| 4,031,180 | 6/1977 | Bohanon | 261/DIG. 41 |
| 4,192,832 | 3/1980 | Goettl | 261/DIG. 46 |
| 4,199,536 | 4/1980 | Yeagle | 261/DIG. 46 |
| 4,333,887 | 6/1982 | Goettl | 261/DIG. 46 |

*Primary Examiner*—Richard L. Chiesa
*Attorney, Agent, or Firm*—Henry Sternberg; Bert J. Lewen

[57] ABSTRACT

A water bleed-off device for an evaporative air conditioner comprising an elongate water collection tray arranged to lie beneath a filter pad/filter pad support frame assembly so that water draining from the bottom of the filter pad is collected by the tray, the tray having a depending funnel arranged to communicate with a drain outlet in the base tank of the air conditioner whereby the water collected in the tray can be bled to drain through the depending funnel.

9 Claims, 5 Drawing Figures

EVAPORATIVE AIR-CONDITIONER WATER BLEED-OFF SYSTEM

Figure 1:
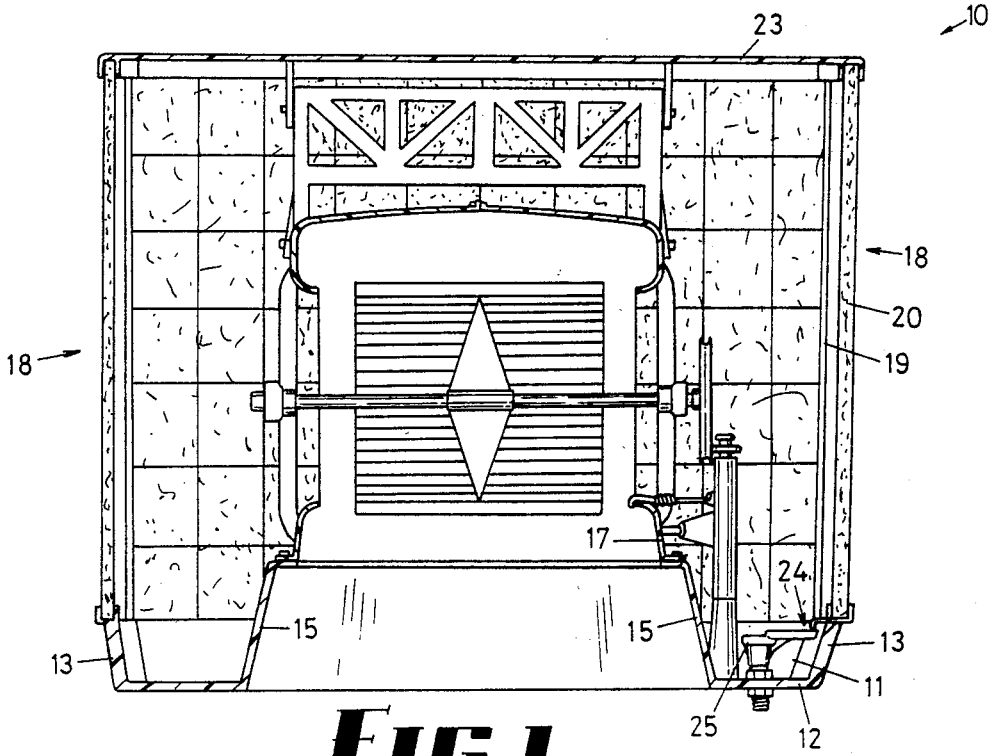

This invention relates to a water bleed-off system for an evaporative air-conditioner, and in particular to a water bleed funnel/overflow fitting, for a large commercial-type evaporative air-conditioner which incorporates a water tank as an integral part thereof.

BACKGROUND TO THE INVENTION

In the air-conditioning industry, the problems caused by build-up or accumulation of salts and other minerals within the filter pads during the evaporation of the water during the cooling process are well known. In an effort to reduce these problems, it is common practice to bleed to waste a certain proportion of the water flowing through the filter pads. The bleed rate of water is normally adjustable depending on the amount of salts and other minerals in the supply water. The bleed rate also needs to be adjustable to compensate in situations where the evaporation rate is very high. One known "bleed-off" arrangement employs a take-off line on the pressure side of the water pump, such line incorporating a flow restricting clamp for restricting the flow of water therethrough and an adjustable water valve to limit the amount of water leaving the water flow system by way of pipe leading to an overflow hose. Such a system is not considered generally satisfactory, and frequently malfunctions through particles in the water recirculating system reducing the orifice in the bleed valve or blocking it totally. Whilst the orifice of such bleed valves is very small, it inherently must be small to allow a low percentage of water to escape under the influence of the pressure needed to recirculate the water.

It is the main object of the present invention to provide an improved water bleed-off system for an evaporative air cooler which is of extremely simple design, inexpensive and can be readily assembled in the cooler body.

It is a further object of the present invention to provide a water bleed-off system for an evaporative air cooler which is able to vary the amount of water which is required to be bled off.

It is still a further object of the present invention to provide a water bleed-off fitting which can also be used as an overflow for the cooler water tank.

It is still a further object of the present invention to provide an improved water bleed-off system which employs a bleed/funnel overflow fitting which can be readily removed from the base wall or floor of the tank of the cooler body and which, when so removed, enables the water from the tank to be drained for cleaning or maintenance purposes.

BRIEF SUMMARY OF THE INVENTION

Broadly according to this invention, there is provided a water bleed-off means for an evaporative air conditioner having a base tank which serves as a water reservoir, side panels upstanding from said base tank around the periphery thereof, at least one of said side panels comprising a filter pad/filter pad support frame assembly, said water bleed-off means comprising an elongate water receiving tray positionable in the base tank so as to lie beneath the filter pad/filter pad support frame assembly with its major axis lying substantially parallel to the plane of said filter pad/filter pad support frame assembly, the length of the tray being substantially less than the width of said filter pad/filter pad support frame assembly, said tray being provided with depending funnel means arranged to communicate with a drain outlet in the base wall of said base tank, the upper end of said funnel means being in water flow communication with the interior of said tray, the arrangement being such that when the conditioner is in use, some of the water draining from the bottom of the filter pad is collected by the water receiving tray and thence bled to drain through said funnel means.

Preferably, the tray is adapted so that portion of the water collected thereby can be returned to said base tank instead of being bled to drain through said funnel means.

In a preferred embodiment, the water receiving tray is divided into three shallow, open top compartments comprising a central compartment and a pair of side compartments one on each side of the central compartment, the compartments being divided by means of transverse upstanding ribs extending laterally across the width of the tray, each of the side compartments having a removable plug.

When each of the removable plugs are inserted in their plugged position, all of the water collected by the water receiving tray will be drained off whereas in the case where one or both of the plugs are removed, some of the water collected by the water receiving tray will be returned to the base tank of the cooler body.

In another preferred embodiment, the levels of the tray and its depending funnel means are arranged so that should water within the base tank reach an "overflow" level, water will drain directly from the base tank via the funnel, which thereby serves as an overflow.

Figure 2:
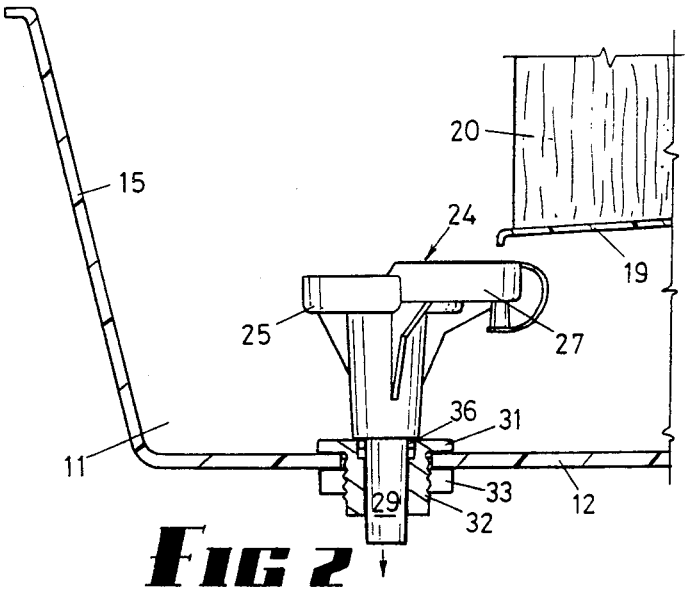
Figure 3:
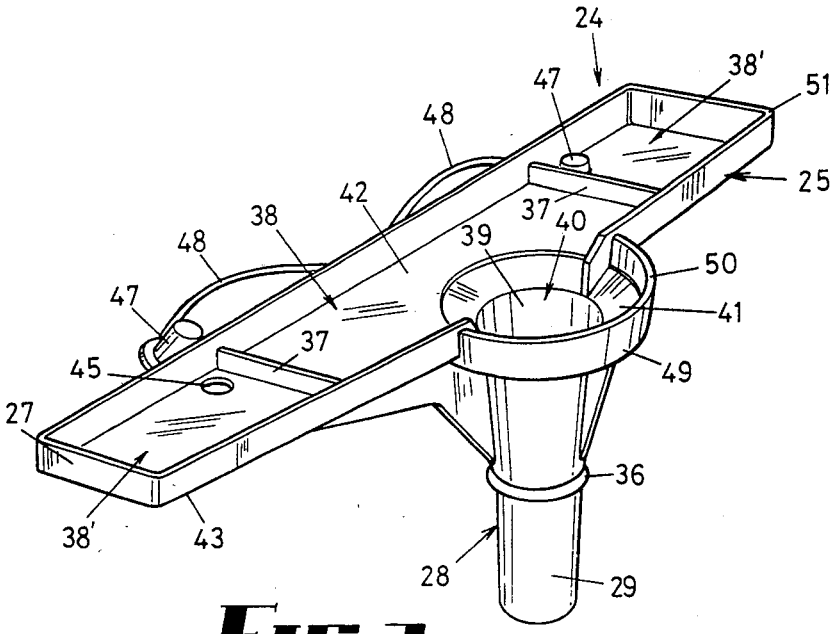
Figure 4:
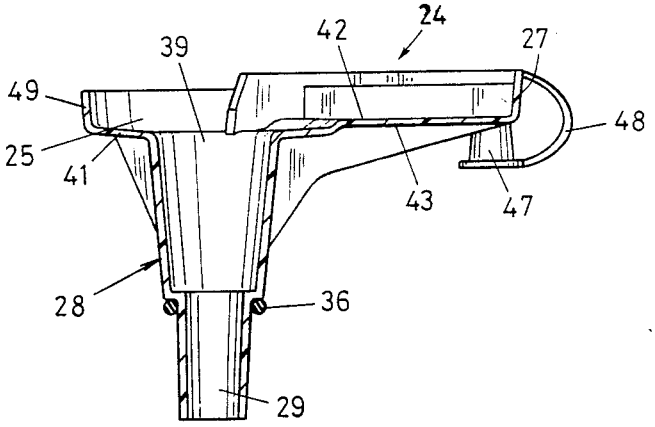
Figure 5:
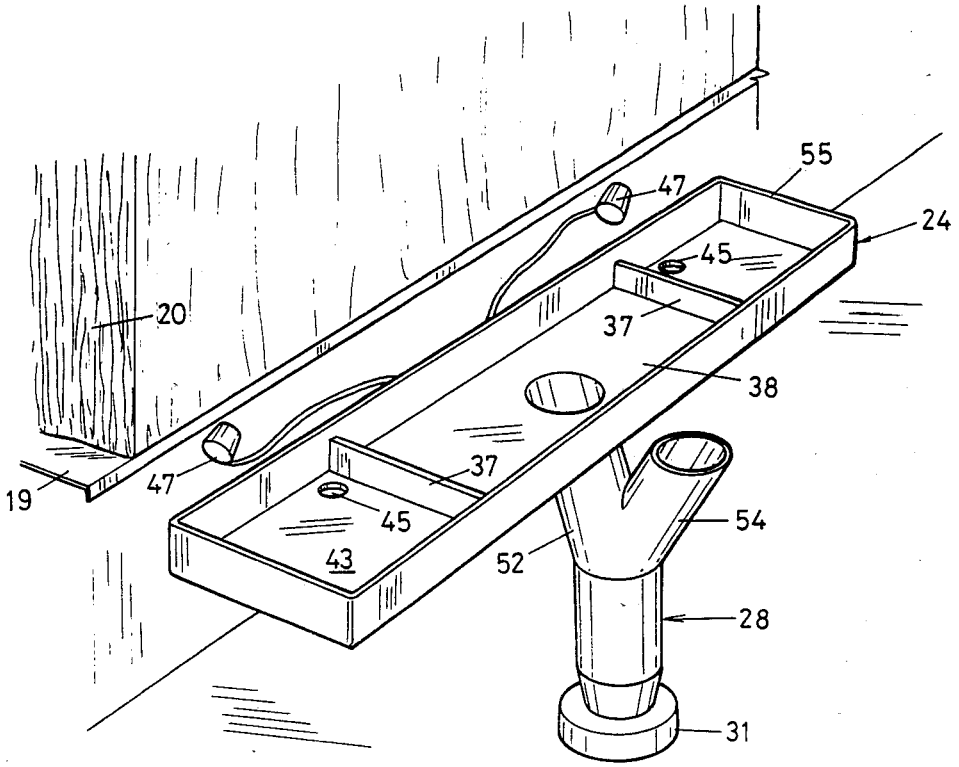

In order to more fully explain the present invention, several embodiments are described hereunder in some further detail with reference to and illustrated in the accompanying drawings in which:

FIG. 1 is a vertical sectional view taken through a cooler of the down-draught type, FIG. 2 is a part sectional view taken through the base tank of the cooler of FIG. 1 showing the water bleed-off device inserted in the drain outlet of the base tank, FIG. 3 is a perspective view of the water receiving tray shown in FIGS. 1 and 2, FIG. 4 is a transverse vertical sectional view taken through the tray of FIG. 3, and FIG. 5 is a perspective view of a water bleed-off tray according to a second embodiment.

In the first embodiment, an evaporative cooler comprises a base tank 11 which is formed from a thermoplastics material by a moulding process, and is provided with a base wall 12 and four outer side walls 13 to form a tray-like member. In the case of a down-draught cooler unit, the base wall 12 is formed to have a central opening (not shown) defined by upstanding inner walls 15, the upper edges of which are engaged by the outlet of the fan casing volute 17. The cooler 10 is also provided with side panels 18 each comprising a filter pad support frame 19, and a filter pad 20 secured thereto. The cooler is also provided with a top panel 23 to complete the cooler body.

In accordance with this invention, there is provided an elongate water receiving tray 24 moulded of thermoplastics material, located beneath one of the filter pads 20, but above the surface of the reservoir water in the base tank 11. The length of the tray 24 is substantially less than the width of the filter pad 20. In this embodiment, the water receiving tray 24 comprises an horizontal shallow tray portion 25 bounded by an upstanding boundary wall 27 and a depending funnel 28 located medially of the tray 24 but displaced to one side thereof such that a substantial portion of the funnel 28 projects outwardly from said one side of the horizontal tray portion 25. The funnel 28 is tapered and has its lower end formed as a spigot 29.

The water receiving tray 24 is secured with respect to the base wall 12 of the water tank 11 by means of a locating bush 31 which is inserted through an aperture formed in the base wall 12, the bush 31 having a threaded outer surface 32 which threadably receives a clamp nut 33 which clamps the bush 31 to the tank base wall 12. The lower end 29 of the funnel 28 is push-fitted into the bush 31 and frictionally retained therein by an interference fit. An O-ring seal 36 is provided between the bush 31 and the outer surface of the funnel lower end 29 to prevent leakage of water from the base tank 11. The bush is connected to an outlet drain (not shown).

In this embodiment, the horizontal tray portion 25 of the water receiving tray 24 is provided with a pair of length-wise spaced partition walls 37 which divide the interior of the tray 24 into three shallow water receiving compartments, namely a large central compartment 38 and two relatively smaller side compartments 38', one on each side of the central compartment 38, the smaller compartments 38' having the same shape and size.

The central compartment 38 communicates with the upper open end 39 of the funnel 28 by means of an opening or gap 40 formed in the tray boundary wall 27, the funnel upper end 39 terminating in an out-turned annular flange 41 which slopes towards the funnel opening 39 and is displaced slightly below the level of the upper surface 42 of the floor 43 of the tray portion 25. Each of the smaller side compartments 38' is provided with a hole 45 into which is removably inserted a drain plug 47, the drain plugs 47 being tethered to the tray 24 by a flexible strap 48 integrally moulded therewith.

That portion of the out-turned annular flange 41 which projects laterally of the tray portion 25 is bounded by an upturned peripheral wall 49, the upper edge 50 of the wall 49 being displaced below the upper edge 51 of the tray boundary wall 27. The wall 49 merges with the wall 27 so that a continuous perimetrical wall is formed around the tray periphery.

In use when the smaller side compartments 38' have their drain plugs 47 inserted, water collected in each compartment of the water receiving tray 24 will flow across the central area of the tray into the funnel open upper end 39 and thence be bled-off through the outlet drain. Removing either one or both of the drain plugs 47 from the smaller side compartments 38' will allow water draining from the filter pad 20 into the compartments 38' to pass through the tray 24 and return immediately to base tank 11 of the cooler 10. In this case, less water is bled away. Thus the rate of bleed can be varied by selectively removing (or replacing ) the plugs within the water receiving compartments 38'. The minimum bleed rate is determined by choosing the appropriate length for the central water receiving compartment 38 which communicates directly with the funnel opening 39.

It is a further feature of this invention that the funnel 28 also serves as an overflow outlet for the base tank 11 of the cooler. Thus, in the event of water rising in the base tank 11 above the level of the upturned edge 50 of the wall 49 bordering (in part) the funnel 28, water will discharge directly through the funnel 28 to the drain outlet. Also, the tray 24 can be readily disconnected from the drain outlet in the base wall of the tank (by simply disengaging the spigot portion 29 of the funnel 28 from the bush 31) to allow the tank to be completely drained for cleaning or maintenance purposes.

In the second embodiment shown in FIG. 5, the tray 24 is formed so that the funnel communicates approximately centrally of the central compartment 38 of the tray 24, the tray 24 having a forked upper end with one of the legs 52 of the fork connecting to the floor 43 of the tray 24, the other leg 54 projecting to one side of the tray with its free end located below the peripheral edge 55 of the tray and serving as the overflow outlet. In all other respects the tray is identical (in principle) to the bleed-off tray described in the first embodiment.

A brief consideration of the above-described embodiments will indicate that the invention is extremely simple but nevertheless provides a very simple, inexpensive and effective water-bleed system for an evaporative air-conditioner.

I claim:

1. In an evaporative air conditioner having a base tank which serves as a water reservoir, side panels upstanding from said base tank around the periphery thereof, said base tank having a base wall with a drain outlet at least one of said side panels comprising frame means for supporting a filter pad;

a water bleed-off means comprising:

a water receiving tray positionable in the base tank so as to lie beneath a filter pad supported by said frame means, the length of said tray being substantially less than the width of a filter pad supported by said frame means, said tray being provided with depending drain means arranged to communicate with said drain outlet in the base wall of said base tank, the upper end of said drain means being in water flow communication with the interior of said tray, the arrangement being such that when the conditioner is in use, some of the water draining from the bottom of the filter pad is collected by said water receiving tray and thence bled to drain through said drain means.

2. In an evaporative air conditioner having a base tank which serves as a water reservoir, said base tank having a base wall with a drain outlet side panels upstanding from said base tank around the periphery thereof, at least one of said side panels comprising a filter pad/filter pad support frame assembly;

a water bleed-off means comprising:

an elongate water-receiving tray positionable in the base tank so as to lie beneath the filter pad/filter pad support frame assembly with its major axis lying substantially parallel to the plane of said filter pad/filter pad support frame assembly, the length of the tray being substantially less than the width of said filter pad/filter pad support frame assembly, said tray being provided with depending funnel means arranged to communicate with said drain outlet in the base wall of said base tank, the upper end of said funnel means being in water flow communication with the interior of said tray, the arrangement being such that when the conditioner is in use, some of the water draining from the bottom of the filter pad is collected by the water receiving tray and thence bled to drain through said funnel means.

3. A water bleed-off means for an evaporative air conditioner according to claim 2 wherein said tray is adapted so that portion of the water collected thereby can be returned to said base tank instead of being bled to drain through said funnel means.

4. A water bleed-off means for an evaporative air conditioner according to claim 2 wherein said funnel means is integrally formed with said tray approximately medially of its length.

5. A water bleed-off means for an evaporative air conditioner according to claim 4 wherein said funnel means comprises a depending tube which tapers in a downwards direction, a portion of the tube being displaced laterally to one side of said tray, said tube having a lower spigot portion which is removably insertable in said drain outlet in the base tank and sealingly engageable therewith.

6. A water bleed-off means for an evaporative air conditioner according to claim 5 wherein the upper end of said funnel terminates in an out-turned annular flange which lies below the level of the base wall of said tray, an outer portion of said out-turned flange being bordered by an arcuate upstanding boundary wall, the upper edge of which lies in a horizontal plane disposed below the horizontal plane containing the upper edge of the boundary wall bordering said tray.

7. A water bleed-off means for an evaporative air conditioner according to claim 2 wherein the tray is enclosed by an upstanding boundary wall, and its interior is divided by transverse partition walls into a plurality of water receiving compartments, each said compartment, excluding the compartment which communicates directly with said funnel means comprising a removable plug located in the floor thereof whereby the rate of water bleed from the tray can be varied by selective engagement of said plugs.

8. A water bleed-off means for an evaporative air conditioner according to claim 2 wherein said water receiving tray is divided into three shallow open topped compartments comprising a large central compartment and a pair of relatively small side compartments one on each side of said central compartment, the compartments being divided by means of transverse upstanding ribs extending across the width of the tray, each of the side compartments having a removable plug.

9. A water bleed-off means for an evaporative air conditioner according to claim 2 wherein said tray and its integrally formed depending funnel are moulded of synthetic plastics material.

* * * * *